United States Patent [19]

Frigo

[11] 4,267,552

[45] May 12, 1981

[54] ELECTROMAGNETIC SOUND GENERATOR FOR AUTOMATIVE VEHICLES AND THE LIKE

[75] Inventor: Domenico Frigo, Olmo, Italy

[73] Assignee: F.I.A.M.M. S.p.A. Fabbrica Italiana Accumulatori Motocarri Montecchio, Montecchio Maggiore, Italy

[21] Appl. No.: 962,156

[22] Filed: Nov. 20, 1978

[30] Foreign Application Priority Data

Nov. 25, 1977 [IT] Italy ..... 41717 A/77
Jun. 20, 1978 [IT] Italy ..... 41599 A/78

[51] Int. Cl.[2] ..... G08B 3/10; G10K 11/10
[52] U.S. Cl. ..... 340/388; 116/142 R
[58] Field of Search ..... 116/142 R; 179/115 ES; 340/404, 391, 388

[56] References Cited

U.S. PATENT DOCUMENTS 1,281,877 10/1918 Teste et al. ..... 116/142 FP
1,335,921 4/1920 Rydberg ..... 116/142 FP
4,057,799 11/1977 Warnod ..... 340/404 X
4,135,473 1/1979 Frigo ..... 116/142 R

FOREIGN PATENT DOCUMENTS 2303335 2/1976 France ..... 116/142 R
1403389 8/1975 United Kingdom ..... 116/142 R

*Primary Examiner*—Daniel M. Yasich
*Attorney, Agent, or Firm*—Karl F. Ross

[57] ABSTRACT

An electromagnetic sound generator, such as an automobile horn, has a thin-walled ferromagnetic coil housing with a rim bent back upon itself to form an outwardly projecting peripheral flange embracing a marginal zone of a membrane. A collar formed as an annular extension of that flange, overlying the membrane, engages a thermoplastic ring with freedom of radial expansion of the latter, the ring being cemented or otherwise secured to an overlying resonator with a convoluted shell.

13 Claims, 15 Drawing Figures

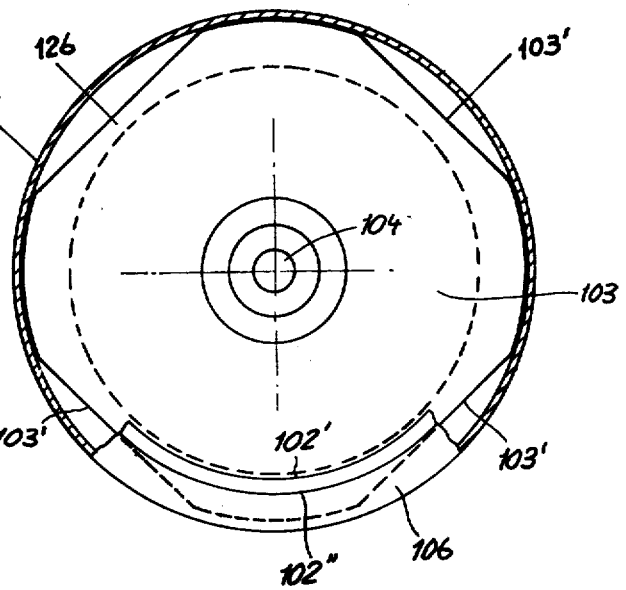
Fig. 12
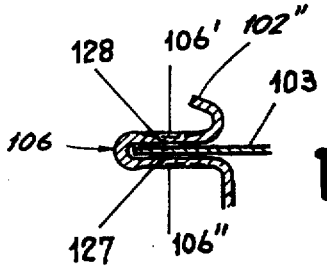
Fig. 14
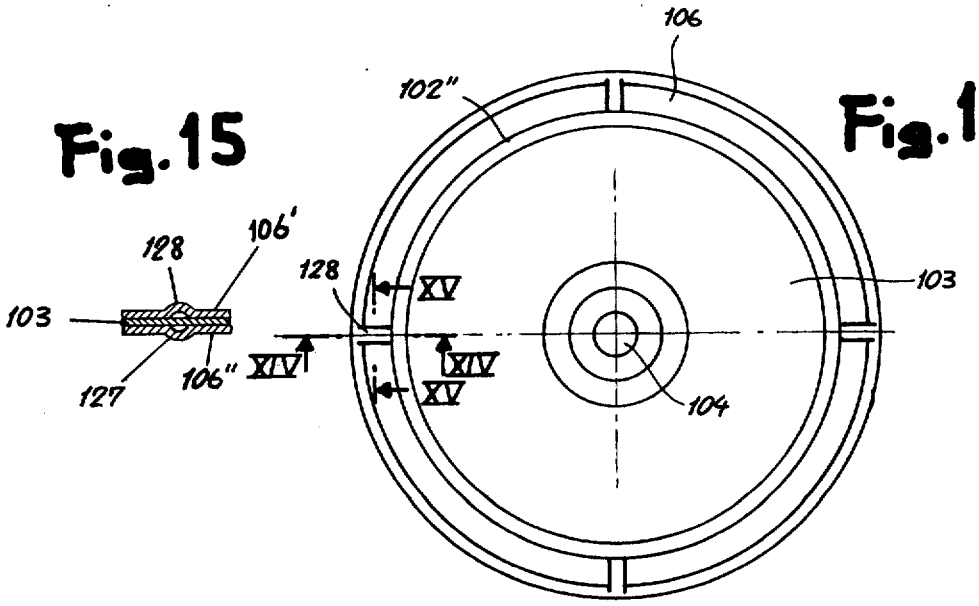
Fig. 13
Fig. 15

ELECTROMAGNETIC SOUND GENERATOR FOR AUTOMATIVE VEHICLES AND THE LIKE

CROSS-REFERENCE TO RELATED APPLICATION

This application contains subject matter described and claimed in my copending application Ser. No. 765,077 filed Feb. 3, 1977, now U.S. Pat. No. 4,134,200.

FIELD OF THE INVENTION

My present invention relates to an electromagnetic sound generator, such as an automobile horn, of the type wherein a generally cup-shaped housing of ferromagnetic sheet metal surrounds an electromagnetic coil coacting with an armature which is carried by a membrane of ferromagnetic material, the membrane being in turn overlain by a resonator forming an air channel.

BACKGROUND OF THE INVENTION

The conventional practice of assembling such sound generators is to clamp the membrane between the housing rim and a generally disk-shaped structure forming part of the resonator, that structure usually consisting of nonmetallic material such as a thermoplastic resin which can be easily molded into the requisite shape. The resonator structure defines a plenum chamber which is open toward the membrane and communicates with the air channel so that standing waves generated in that chamber by the oscillating membrane give rise to a vibrating air column in the channel. The latter often is of spiral shape, defined by a convoluted shell of the resonator structure.

In prior-art sound generators of this type the membrane has a marginal zone clamped between confronting flanges of the coil housing and the resonator structure which are bolted or riveted to each other. In order to insure a firm grip on the membrane periphery while still allowing its central portion to vibrate with the necessary stroke amplitude, the flanges must be substantially nondeformable under the stresses locally generated by the peripherally spaced fasteners. Thus, the housing flange is generally given a thickness exceeding that required for the completion of the magnetic circuit while the resonator structure is reinforced by an annular metallic disk bounding the plenum chamber. The production of such a disk, usually by deep-drawing from a sheet, is wasteful since a large central part must be removed in order to give access to the air channel; also, the assembly of the several components referred to is laborious and time-consuming.

In my above-identified prior U.S. Pat. No. 4,134,200 I have disclosed an improved sound generator of this type in which the peripheral housing wall has a rim bent back upon itself to form an outwardly projecting two-ply flange enfolding a marginal zone of the membrane, with radial separation of a bight portion of the flange from the membrane periphery to give that membrane a certain mobility.

OBJECTS OF THE INVENTION

An object of my present invention is to provide a further improvement in the construction of a sound generator which obviates any major stresses upon the membrane that might result from differences in the thermal coefficients of expansion of the housing and the resonator.

Another object is to facilitate the venting of the interior of the housing to the atmosphere for the purpose of equalizing the air pressure on opposite sides of the membrane to prevent any deformation of the latter by vapors evolving within the housing.

SUMMARY OF THE INVENTION

In accordance with my present invention, the resonator structure of the sound generator is supported on the coil housing through the intermediary of a coupling ring, preferably consisting of the same thermoplastic material as the resonator, which surrounds the aforementioned plenum chamber and is engaged by the membrane-enfolding housing rim with freedom of relative radial expansion.

Pursuant to a more particular feature of my invention, the outer one of the plies of the flange constituting the housing rim—in accordance with the teaching of my prior U.S. Pat. No. 4,134,200—has a generally axial extension which forms a retaining collar axially bearing upon the coupling ring so as to hold it in position without interfering to any significant extent with the radial expansion or shrinkage of that ring. Advantageously, the axial force is exerted by peripherally spaced deformations which interlockingly engage the coupling ring for holding it against rotation.

The collar formed by the outer ply of the housing flange may be disposed either outside or inside the coupling ring. In the first instance, the ring may rest on a part of the membrane seated on a radially inwardly extended portion of the inner ply. In the second instance, the ring is carried by the entire flange and does not come into contact with the membrane. In either case, but especially in the last-mentioned one, it may be desirable to facilitate the escape of gases from the interior of the housing around the edge of the membrane by providing the latter with peripherally spaced cutbacks and/or forming the plies of the flange with generally radial venting channels confronting the membrane.

BRIEF DESCRIPTION OF THE DRAWING

The above and other features of my invention will now be described in detail with reference to the accompanying drawing in which:

FIG. 12 is a plan view (parts broken away) similar to FIG. 10, illustrating a modified membrane;

FIG. 13 is another view similar to FIG. 10, illustrating a further modification; and FIGS. 14 and 15 are cross-sectional detail views respectively taken on lines XIV—XIV and XV—XV of FIG. 13.

SPECIFIC DESCRIPTION

Figure 1:
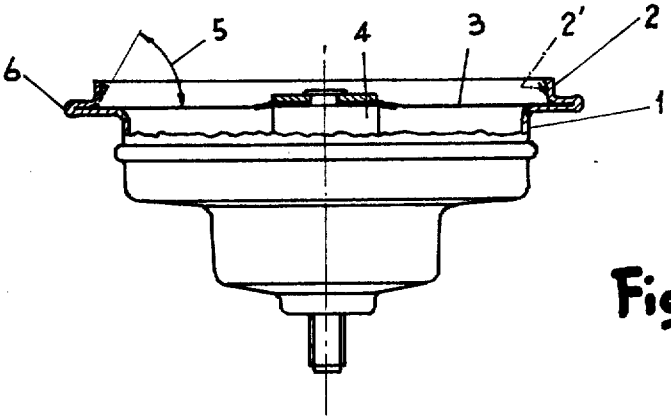
FIG. 1 is an elevational view, partly in section, of the coil housing of a sound generator according to my invention.
Figure 2:
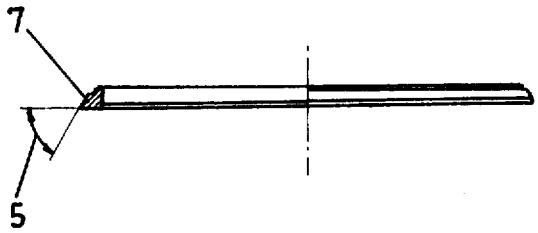
FIG. 2 is a part-sectional view of a coupling ring adapted to be fitted onto the housing of FIG. 1.
Figure 3:
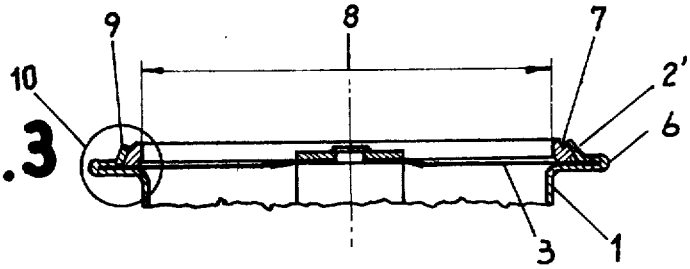
FIG. 3 shows, in axial section, the upper part of the housing of FIG. 1 with the ring of FIG. 2 positioned thereon.
Figure 4:
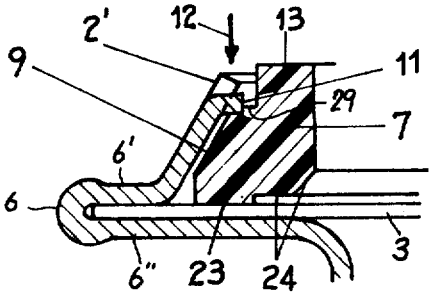
FIG. 4 is an enlarged sectional view of a detail of the assembly of FIG. 3.

In FIGS. 1–6 I have shown a sound generator comprising a ferromagnetic housing 1, similar to that of the generator described in my prior U.S. Pat. No. 4,134,200, which accommodates an electromagnetic coil 25 coacting with an armature 4 carried on a ferromagnetic membrane 3. Housing 1 has a rim 6 in the form of a two-ply flange enfolding a peripheral zone of membrane 3, the bight portion of that flange being radially spaced from the edge of the membrane as discussed in that prior patent. The outer ply 6' of flange 6, i.e. the upper one as viewed in the drawing, is foreshortened with reference to the inner or lower ply 6' and is axially extended into a bead 2, originally of cylindrical shape, into which a coupling ring 7 of thermoplastic material is then inserted so as to come to rest on the membrane by a bottom surface 23 overlying the extended seat formed by the lower ply 6'', as best seen in FIG. 4. That bottom surface is partly cut away, as shown to 24, to enlarge the oscillatable central portion of the membrane and to minimize the pressure exerted upon that membrane by the ring. After the emplacement of ring 7, bead 2 is deformed inwardly into a frustoconical collar 2' with generatrices paralleling those of the beveled outer ring periphery from which the collar is spaced by an annular clearance 9 facilitating thermal expansion of the ring; these generatrices include with the plane of the membrane 3 an angle 5 of about 45° to 60°.

Figure 5:
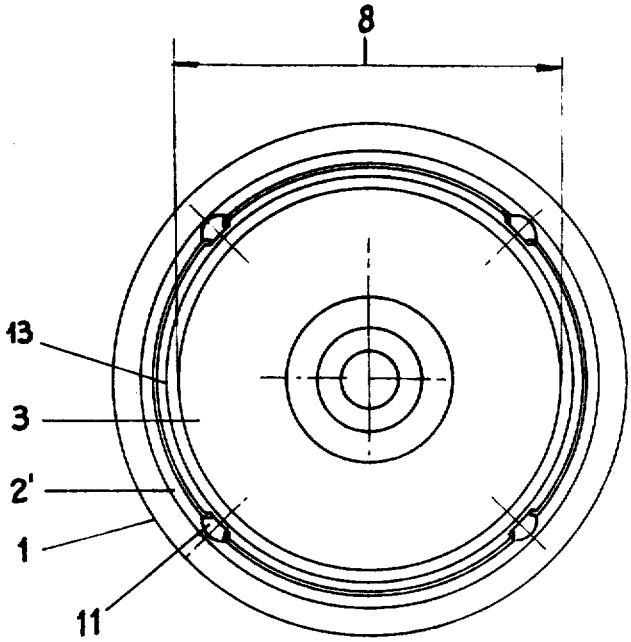
FIG. 5 is a plan view of that assembly.
Figure 6:
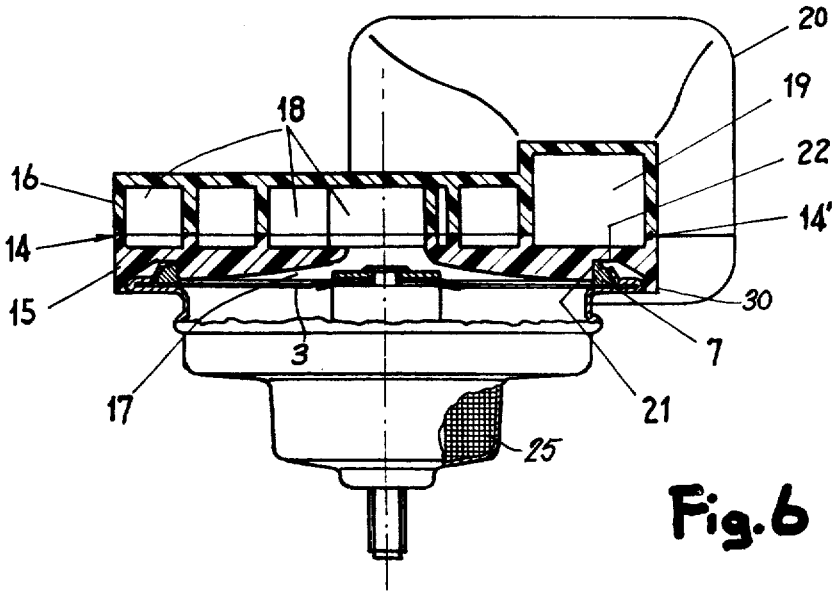
FIG. 6 is a view similar to FIG. 1, showing the complete sound generator.
Figure 7:
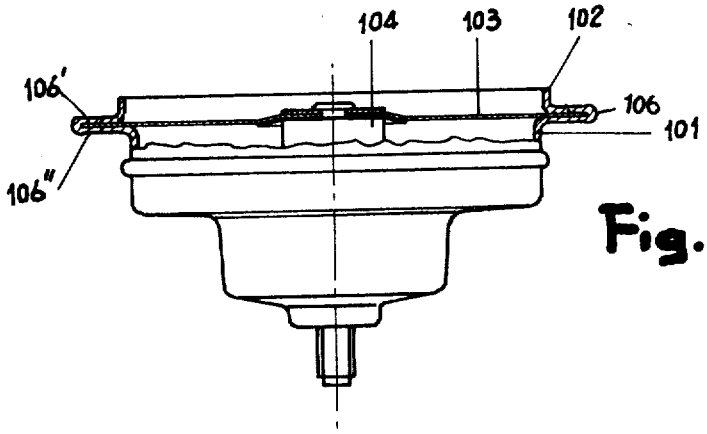
FIGS. 7, 8, 9, 10 and 11 are views similar to those of FIGS. 1, 2, 3, 5 and 6, respectively, but relating to another embodiment.

As shown in FIGS. 4 and 5, the frustoconically deformed collar 2' is provided with a number of peripherally spaced incisions forming lugs or tongues 11 which are bent inwardly to engage in corresponding notches of an annular shoulder formed by a rabbet 29 of ring 7, thereby preventing its rotation about the housing axis. The lugs 11 also exert a certain axial pressure upon the ring 7 as indicated in FIG. 4 by an arrow 12. An annular land in the form of a ridge 13 rises above rabbet 29 and beyond the collar 2' to form a support for a resonator structure 14 shown in FIG. 6, that structure being generally similar to the one described and illustrated in my prior patent identified above. Structure 14 consists essentially of two complementary portions 15 and 16 of a convoluted shell, bonded to each other along a plane 14' transverse to the axis, which forms an air channel 18 of spiral configuration terminating in an enlarged throat 19 which opens onto a mouth 20. Lower shell portion 15 has a reduced neck with a cylindrical peripheral surface 21 whose diameter corresponds to the inner diameter 8 (FIGS. 3 and 5) of ring 7 and which is thus received with a close fit by that ring, the shell coming to rest on ridge 13. An annular recess 22 on the underside of shell portion 15 accommodates the ring 7 and the collar 2' with all-around clearance while a skirt 30 of that shell portion extends around the housing flange 6. Shell portion 15 forms a plenum chamber 17, bounded by ring 7, which is open toward the membrane 3 and also communicates with air channel 18. Ring 7 and shell portion 15 can be bonded to each other with the aid of an adhesive, by ultrasonic fusion or by a heat seal, if desired, though a friction fit may be sufficient in many instances.

In FIGS. 7–15 I have shown another embodiment in which elements analogous to those of FIGS. 1–6 have been designated by like reference numerals preceded by a "1" in the hundreds position; these elements, therefore, will be described hereinafter only to the extent that they differ from their counterparts in the first embodiment.

Figure 9:
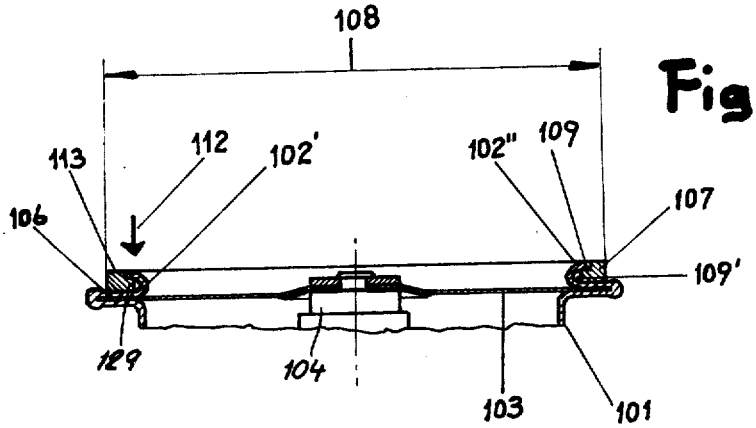
Figure 8:
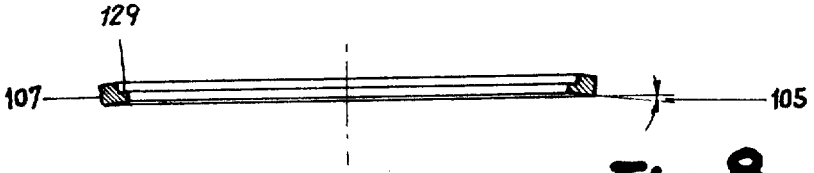
Figure 10:
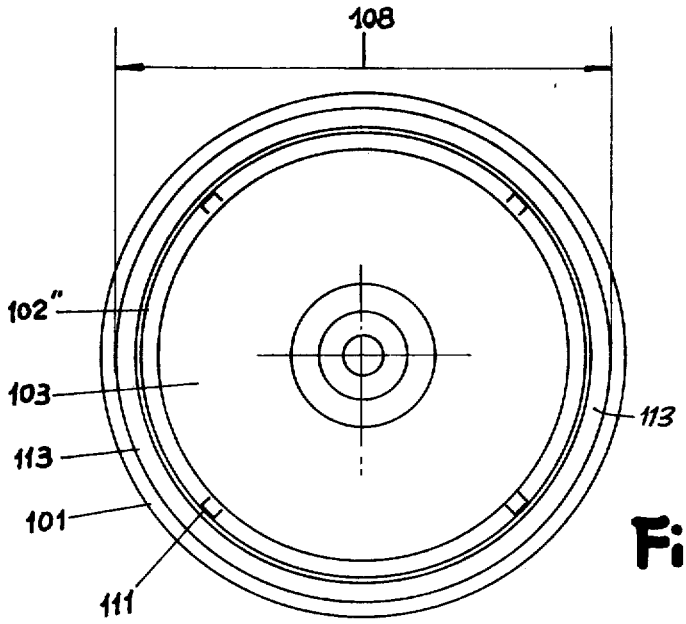
Figure 11:
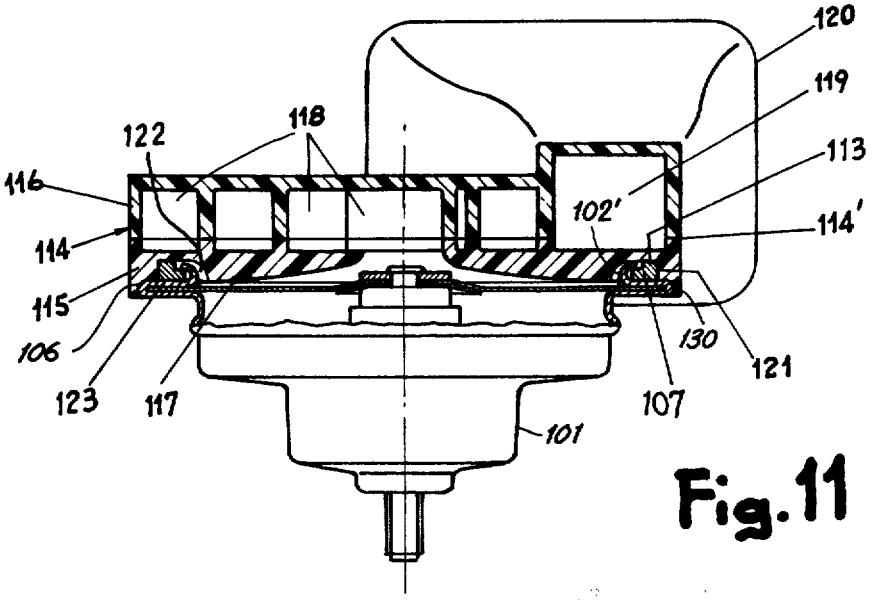

In this instance, too, the outer or upper ply 106' of a two-ply housing flange 106 is upwardly extended into an initially cylindrical bead 102 (FIG. 7) which, after emplacement of a coupling ring 107, is deformed outwardly into a generally toroidal collar 102' with a peripheral lip 102'' as shown in FIG. 9. The coupling ring 107 has an inner annular rabbet 129 engaged by the overhanging lip 102'' with a certain axial pressure (arrow 112), the lip 102'' being incised at peripherally spaced locations to form tongues 111 engaging in complementary indentations of rabbet 129 for preventing any relative rotation between the ring and the housing. The lower surface of ring 107 is beveled at an angle 105 to conform to the shape of ply 106'.

The lower shell portion 115 of resonator structure 114 is provided with a skirt 130 which embraces the flange 106 of housing 101 and has a cylindrical inner peripheral surface 121 whose diameter corresponds to the outer diameter 108 of coupling ring 107. Shell portion 115 has its underside annularly recessed at 122 to accommodate the ring 107 and the collar 102'. The lower face 123 of ring 107 rests on the upper ply 106' of flange 106 by which it is separated from the membrane 103. Again, if desired, the frictionally interfitted resonator structure and coupling ring may be adhesively or otherwise bonded to each other. The upper ring face 113 supporting the shell portion 115 projects only slightly above the lip 102'' of collar 102'.

To prevent any deformation of the coupling ring 7 during its assembly with the housing, the ring may be temporarily fitted onto a rigid core whose outer diameter conforms to ring diameter 8 while the bead 2 is being given its upwardly converging shape. Similarly, the coupling ring 107 may be inserted into a rigid sleeve whose inner diameter conforms to ring diameter 108 while the bead 102 is being deformed outwardly around its rabbet 129.

In FIG. 12 I have shown the membrane 103 formed with four peripheral cutbacks 103' along mutually orthogonal straight lines closely approaching the inner diameter of flange 106 to facilitate the venting of the interior of housing 101 to plenum chamber 117 and thus to the surrounding atmosphere. In the region of these cutbacks the membrane is separated only by a narrow strip 126 from the inner edge of collar 102' so that gases evolving within the housing can enter the flange 106 between its plies and escape around the rectilinear edges of the membrane which is only loosely received between these plies. Membrane 3 of FIGS. 1–6 could be similarly cut back to foreshorten the escape route of internal gases.

Alternatively, as shown in FIGS. 13–15, the plies 106' and 106'' (or their counterparts 6' and 6'' in the preceding embodiment) may be provided with membrane-confronting channels 127, 128 defining an escape path around the membrane edge which is spaced from the bight of flange 106.

I claim:

1. In an electromagnetic sound generator including a generally cup-shaped housing of ferromagnetic sheet metal for an electromagnetic coil, a generally circular ferromagnetic membrane carrying an armature coacting with said coil, said housing having a rim bent back upon itself and supporting said membrane, and resonator means overlying said membrane, said resonator means having a generally disk-shaped structure coaxial with said housing, the combination therewith of a coupling ring resting on said rim above said membrane and having a rabbeted upper face which forms an annular shoulder engaged by at least one deformed portion of said rim from above with freedom of relative radial expansion, said upper face being provided with an annular land projecting above said shoulder, said structure being supported on said annular land and defining a plenum chamber open toward said membrane within the confines of said coupling ring.

2. The combination defined in claim 1 wherein said structure and said coupling ring consist of thermoplastic material.

3. The combination defined in claim 1 wherein said rim forms an outwardly projecting flange with an upper ply and a lower ply interconnected by a bight portion, said flange enfolding a marginal zone of said membrane, said outer ply having a rising extension which forms a retaining collar bearing down upon said shoulder.

4. The combination defined in claim 3 wherein said collar is provided with peripherally spaced deformations interlockingly engaging said coupling ring for holding same against rotation.

5. The combination defined in claim 3 or 4 wherein said collar surrounds said coupling ring with radial clearance.

6. The combination defined in claim 5 wherein said lower ply projects radially inwardly beyond said collar to form an extended seat for said membrane, said coupling ring resting on said membrane in the area of said extended seat.

7. The combination defined in claim 5 wherein said collar is of substantially frustoconical shape, said coupling ring having a substantially frustoconical outer peripheral surface with generatrices paralleling those of said collar.

8. The combination defined in claim 3 or 4 wherein said collar bounds said plenum chamber and is surrounded by said coupling ring with radial clearance.

9. The combination defined in claim 8 wherein said marginal zone is provided with peripherally spaced cutbacks approaching said collar for facilitating a venting of the interior of said housing to said plenum chamber.

10. The combination defined in claim 8 wherein said plies are formed with generally radial channels confronting said membrane and extending into said bight portion for facilitating a venting of the interior of said housing to said plenum chamber.

11. The combination defined in claim 3 or 4 wherein said structure forms an annular recess around said plenum chamber accommodating said collar and at least a part of said coupling ring including said annular land, said structure further having an annular skirt surrounding said recess and embracing said flange.

12. The combination defined in claim 11 wherein said annular land is in contact with at least one peripheral wall of said recess.

13. The combination defined in claim 1, 2, 3 or 4 wherein said structure forms a convoluted air channel communicating with said plenum chamber.

* * * * *